United States Patent [19]

Terry

[11] 4,051,642

[45] Oct. 4, 1977

[54] MODULE BUILDING FOUNDATION AND FLOOR SYSTEM

[76] Inventor: John H. Terry, 505 Park Terrace, Pine Bluff, Ark. 71601

[21] Appl. No.: 618,552

[22] Filed: Sept. 30, 1975

[51] Int. Cl.[2] ..... E02D 27/00; E04B 1/02

[52] U.S. Cl. ..... 52/293; 52/563; 52/294; 52/593; 52/263

[58] Field of Search ..... 52/126, 263, 293, 294, 52/292, 299, 402, 480, 562, 563, 564, 584, 615, 621, 169, 568

[56] References Cited

U.S. PATENT DOCUMENTS

| | | | |
|---|---|---|---|
| 1,451,000 | 4/1923 | White | 52/563 |
| 1,589,938 | 6/1926 | Burney | 52/294 |
| 2,920,475 | 1/1960 | Graham | 52/293 |
| 3,082,489 | 3/1963 | Douglas | 52/261 |
| 3,184,013 | 5/1965 | Pavlecka | 52/615 |
| 3,676,971 | 7/1972 | Dombroski | 52/593 |
| 3,772,835 | 11/1973 | Cox | 52/293 |

*Primary Examiner*—Price C. Faw, Jr.
*Assistant Examiner*—Robert C. Farber
*Attorney, Agent, or Firm*—Clarence A. O'Brien; Harvey B. Jacobson

[57] ABSTRACT

A building foundation is formed from precast modular components assembled in situ to enclose plumbing and ducting. The components include foundation pads clamped together and interfitted with perimeter wall sections and spacer posts for support of floor panels held together by slots in the top of the wall sections and the spacer posts.

13 Claims, 19 Drawing Figures

MODULE BUILDING FOUNDATION AND FLOOR SYSTEM

This invention relates to the prefabrication of a building foundation and floor utilized in the support of residential and commercial buildings.

Many innovations have been made or proposed in connection with the prefabrication of buildings. However, prefabrication has not been generally utilized in connection with the formation of building foundations. Prefabricated modular building components and their assembly for flooring and walls are of course well known as disclosed in U.S. Pat. Nos. 881,700, 2,971,295, 3,082,489, 3,295,272 and 3,305,982. However, as already noted, the prior art as exemplified by the foregoing patents, does not extend the prefabrication concept to the actual building foundation itself. It is therefore an important object of the present invention to provide for the formation of a building foundation from modular components assembled whenever desired so as to avoid the weather, seasonal and climatic limitations ordinarily associated with the construction or casting of building foundations in situ. An additional object is to provide a building foundation from prefabricated components capable of being assembled in such a manner so as to avoid human errors and lack of precision heretofore associated with the construction of building foundations.

In accordance with the present invention, a building foundation is assembled from precast modular components that are accurately interfitted with each other in order to form the desired foundation. The modular components include ground bearing pads that are clamped to each other along peripheral rim portions, to form an assembly of pads on which perimeter wall sections are supported. The ground bearing pads are provided with intermediate upstanding ribs formed with openings within which projections from spacer posts are received. A plurality of wall surface panels are supported in spaced relation above the ground bearing pads by the wall sections and the spacer posts. The upper surfaces of the wall sections and spacer posts are slotted so as to hold the floor panels in abutting relationship to completely enclose space within which hidden plumbing and ducting may be installed.

These together with other objects and advantages which will become subsequently apparent reside in the details of construction and operation as more fully hereinafter described and claimed, reference being had to the accompanying drawings forming a part hereof, wherein like numerals refer to like parts throughout.

Figure 1:
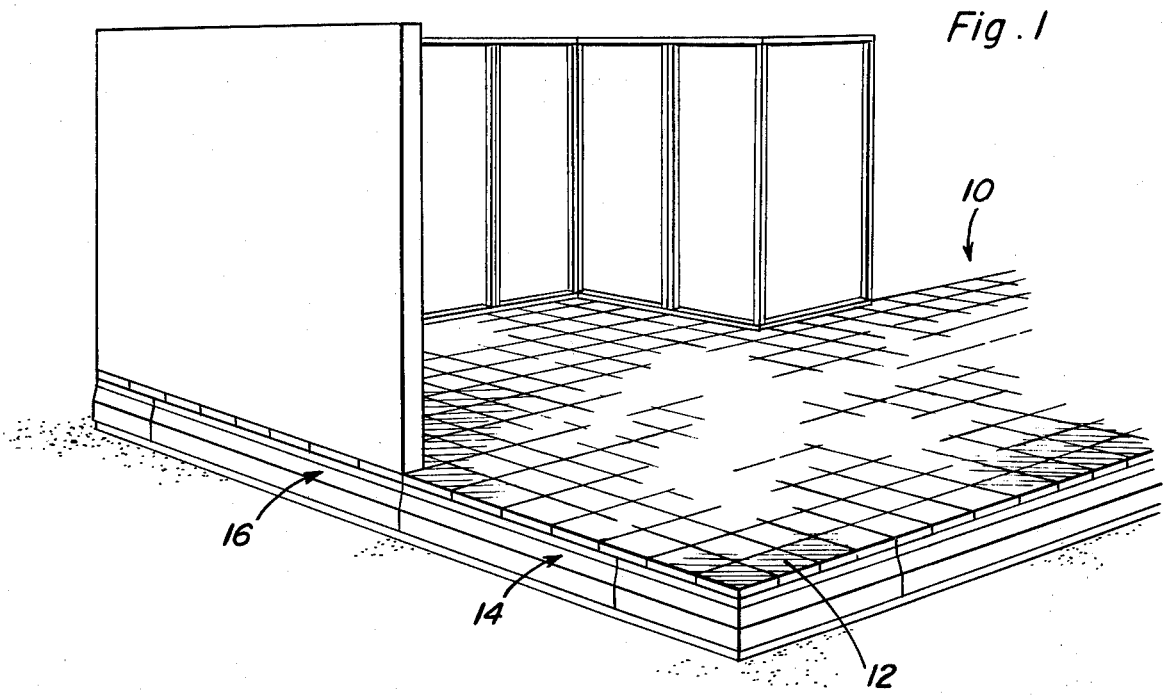
FIG. 1 is a perspective view showing a typical building foundation assembled from modular components in accordance with the present invention.
Figure 2:
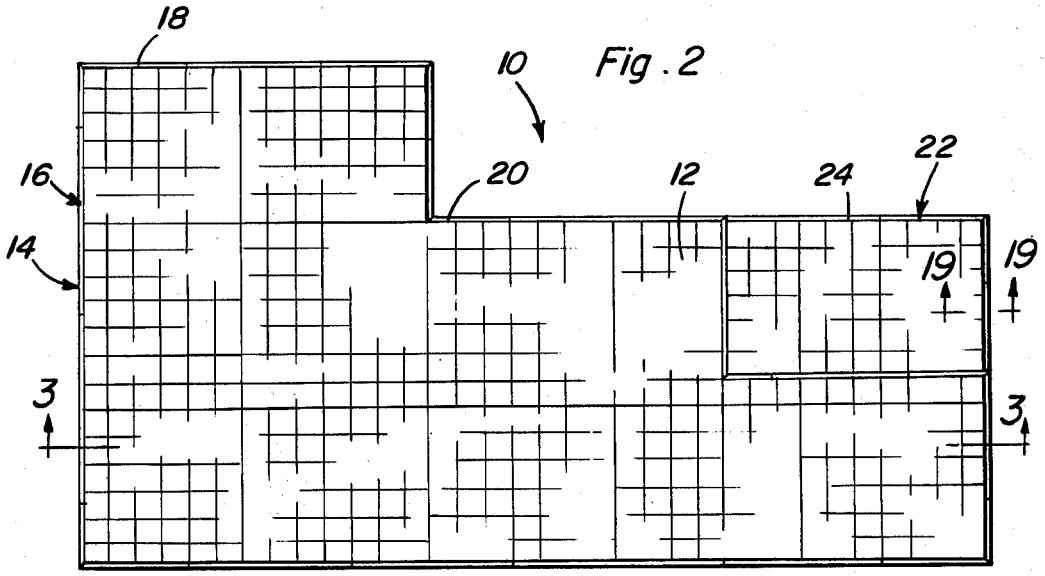
FIG. 2 is a top plan view of the foundation assembly shown by way of example in FIG. 1.

Referring now to the drawings in detail, FIGS. 1 and 2 illustrate a typical building foundation assembly constructed in accordance with the present invention and generally denoted by reference numeral 10. The visible portions of the foundation assembly 10 as shown in FIGS. 1 and 2, include a plurality of abutting floor panels 12 and a load bearing perimeter wall assembly 14. The perimeter wall assembly 14 includes straight wall sections 16, outside corner wall sections 18 and inside corner wall sections 20. Except for a 45° beveled end on the perimeter wall sections 18 and 20, all of the wall sections 16, 18 and 20 are of similar construction as will be described in detail hereafter. Another type of wall assembly 22 may be utilized for a portion of the foundation assembly as shown in FIG. 2 for support of a carport or garage wall. The wall assembly 22 is also formed from separate wall sections 24 to be described in detail hereafter.

The floor panels 12 may be made of different materials including molded plastic, fiberglass or aluminum. Each floor panel 12 as more clearly seen in FIG. 5, includes a top sheet of material 26 that is generally rectangular in shape and from which a peripheral flange 28 depends. Intersecting, reinforcing ribs 30 also depend from the top sheet 26 and extend between opposite sides of the peripheral flange 28. The floor panels 12 form a planar surface when adjacent panels abut each other along the sides of the peripheral flanges 28.

Figures 3, 4, 5, 6, 7, 19:
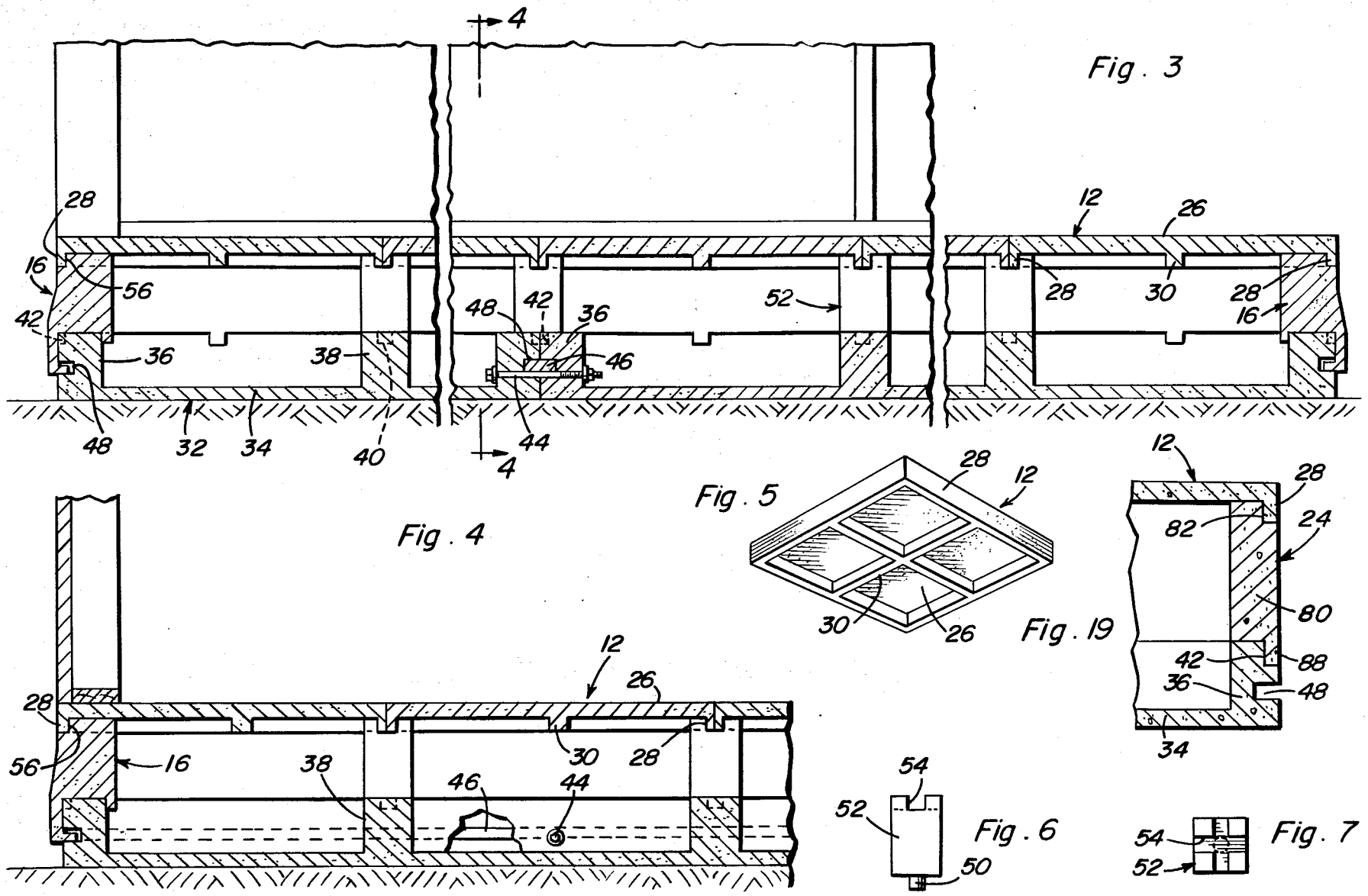
FIG. 3 is an enlarged partial sectional view taken substantially through a plane indicated by section line 3—3 in FIG. 2.
FIG. 4 is a partial sectional view taken substantially through a plane indicated by section line 4—4 in FIG. 3.
FIG. 5 is a perspective view illustrating one of the floor panels associated with the foundation assembly.
FIG. 6 is an elevational view of one of the spacer posts associated with the foundation assembly.
FIG. 7 is a top plan view of the spacer post shown in FIG. 6.
FIG. 19 is an enlarged sectional view taken substantially through a plan indicated by section line 19—19 in FIG. 2.
Figure 11:
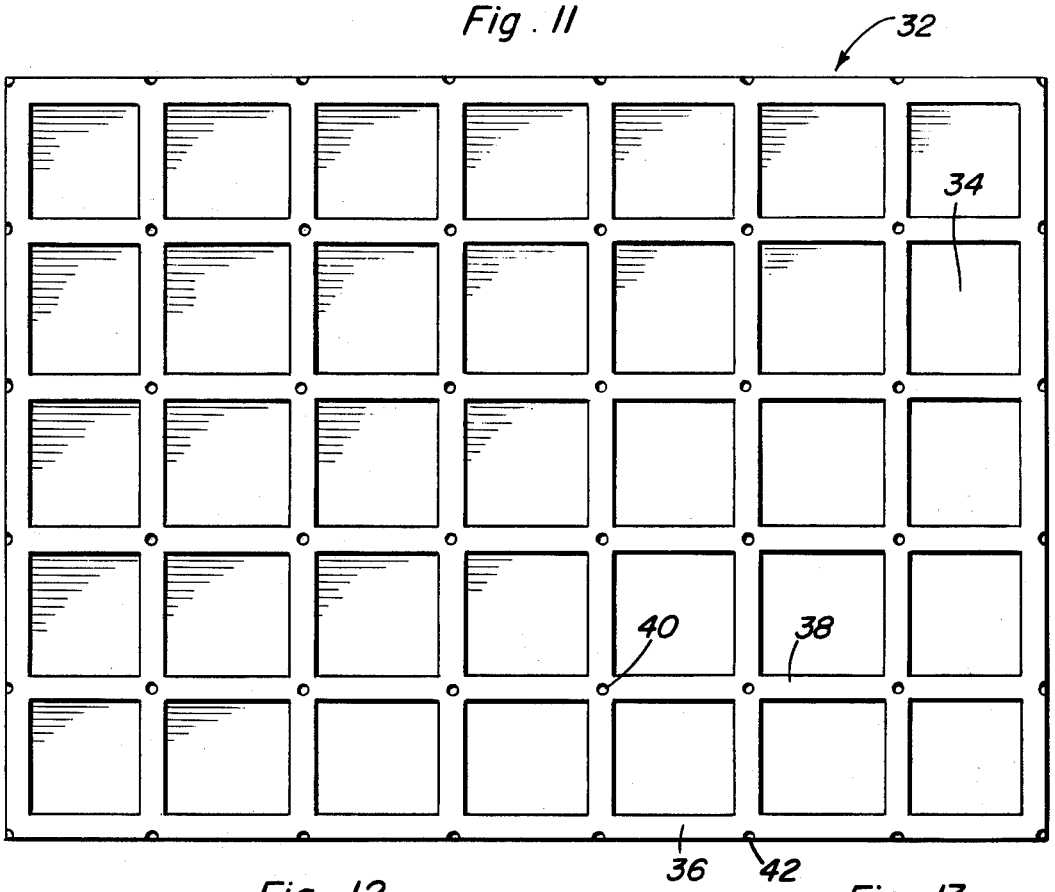
FIG. 11 is a top plan view of one of the ground bearing pads associated with the foundation assembly.

The floor panels 12 are supported by the perimeter wall sections in spaced relation above a plurality of interconnected ground bearing pads 32 as more clearly seen in FIGS. 3 and 11. Each ground bearing pad may be precast from a suitable load bearing material such as concrete and includes a ground bearing surface portion 34 from which a peripheral rim portion 36 extends upwardly. Upstanding reinforcing ribs 38 intersect with each other and interconnect the sides of the peripheral rim portion 36. Circular recesses 40 are formed in the upper surface edges of the ribs where they intersect as more clearly seen in FIG. 11. Semi-circular key slots 42 are formed on the external edges of the peripheral rim portion 36 in alignment with the ribs 38.

Figure 10:
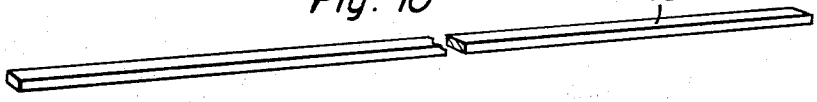
FIG. 10 is a perspective view illustrating one of the key strips associated with the foundation assembly.

As more clearly seen in FIG. 3, adjacent ground bearing pads 32 are clamped together by clamping bolts 44 that extend through abutting rim portions 36. The adjacent pads 32 are properly aligned prior to clamping by means of key strips 46 cut to a desired length as shown in FIG. 10. The key strip 46 is received within confronting and aligned flange slots 48 formed within the exterior surface of each rim portion 36. The semi-circular key slots 42 of the abutting rim portions 36 also form a complete circular recess dimensionally equal to the recesses 40 formed in the top of each of the ribs 38 of the pads 32.

The recesses 40 on the top edges of the ribs 38 as well as the circular recesses formed by the key slots 42 of abutting rim portions 36, receive projections 50 that depend from the bottoms of spacer posts 52. The spacer posts are also formed with cross slots 54 on their upper ends as more clearly seen in FIGS. 6 and 7. The cross slots 54 are adapted to receive abutting peripheral flanges 28 of the floor panels 12 as more clearly seen in FIGS. 3 and 4. Thus, the spacer posts 52 not only support the floor panels in spaced parallel relationship to the ground bearing pads 32 but also hold the floor panels in assembled relationship because of the interfitting of the abutting flanges 28 into the cross slots 54.

Figure 8:
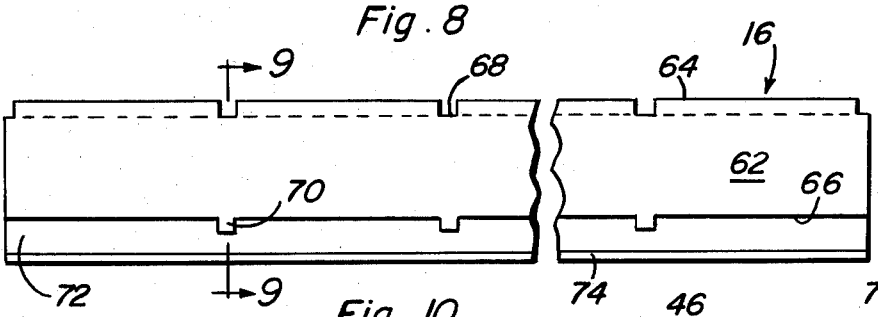
FIG. 8 is an inside elevational view of a perimeter wall section associated with the foundation assembly.
Figure 9:
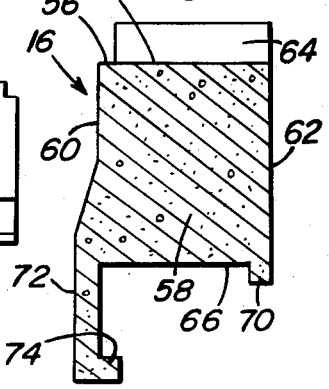
FIG. 9 is an enlarged transverse sectional view taken substantially through a plane indicated by section line 9—9 in FIG. 8.

The portions of the floor panels 12 that do not abut and therefore form the periphery of the foundation assembly, are fitted into a recess 56 formed in each perimeter wall section 16, 18 and 20 as shown in FIGS. 3 and 4. As more clearly seen in FIGS. 8 and 9, each perimeter wall section such as wall section 16 is made of a precast material such as concrete forming a generally rectangular body 58 in cross section having an external face 60, an interior face 62, an upper face 64 and a lower face 66. The upper face 64 is formed with transverse slots 68 adapted to receive the depending ribs 30 of the floor panels 12 . The lower face 66 of the wall section rests on top of a peripheral rim portion 36 of the ground bearing pad and is locked to the rim portion by projections 70 extending from the intersection of the lower face 66 and the interior face 62 and a locking flange 72 that projects from the exterior face 60 below the lower face 62. The inturned end 74 of the flange 72 is received within the flange slot 48 of the rim portion 36 as shown in FIGS. 3 and 4. It will therefore be apparent that the various modular components of the foundation assembly will accurately interfit with each other to form a firm and rigid assembly.

Figure 12:
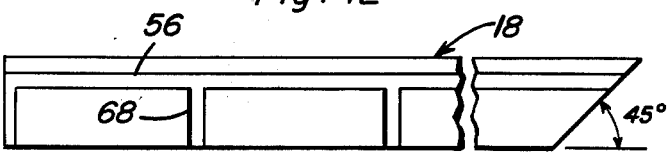
FIG. 12 is a partial top plan view of one of the perimeter wall sections associated with the foundation assembly.
Figure 13:
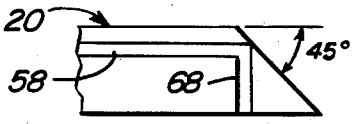
FIG. 13 is a side elevational view of a portion of another perimeter wall section.

As shown in FIGS. 12 and 13, the corner wall sections 18 and 20 are similar to the straight wall sections 16 hereinbefore described except that they are respectively provided with 45° beveled corner edges 76 and 78. It will also be noted from FIG. 2, that the wall sections 16, 18 and 20 are arranged so that they overlap adjacent the ground bearing pads in order to form a more rigid and secure assembly that will not split at the abutting rim portions of adjacent pads 32.

As hereinbefore indicated, a portion of the foundation assembly supports wall assembly 22 formed by wall sections 24. The wall sections 24 as more clearly seen in FIGS. 14, 16, 17 and 18, are made of a precast concrete body 80 of generally rectangular cross section somewhat less massive than the perimeter wall sections 16 hereinbefore described, since they do not overhang the inside surfaces of the rim surfaces 36. The upper face of the rectangular body 80 includes a longitudinal recess 82 intersected by slots 84 similar to the recesses 56 and slots 68 associated with the perimeter wall sections 16 aforementioned. The slots 84 are therefore spaced from each other a distance to receive the ribs 30 of the wall panels 12 while the peripheral flanges 28 are received within the longitudinal recesses 82 as more clearly seen in FIG. 19. The lower face of the wall section 24 adjacent the external face 86, is provided with longitudinally spaced semi-cylindrical projections 88 adapted to be received within the semi-cylindrical slots 42 of the rim portion 36 as more clearly seen in FIG. 19. Quarter round projections 90 project however from the longitudinal ends of each wall section 24 so that a semi-cylindrical projection will be formed when the ends of wall sections 24 abut, the abutting projections 90 then being received within a common recess 42 to not only align both of the wall sections 24 but to also hold them together in interfitting relationship with the pad 32 on which they are mounted.

Figure 14:
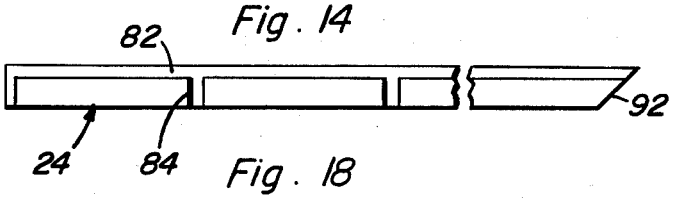
FIG. 14 is a partial top plan view of another type of wall section utilized in the foundation assembly.
Figure 15:
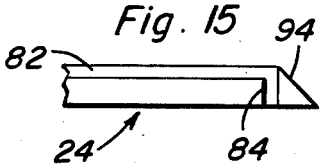
FIG. 15 is a top plan view of a portion of another wall section of the type shown in FIG. 14.
Figure 18:
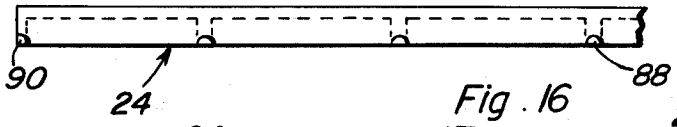
FIG. 18 is a bottom plan view of a portion of the wall section shown in FIGS. 16 and 17.
Figure 16:
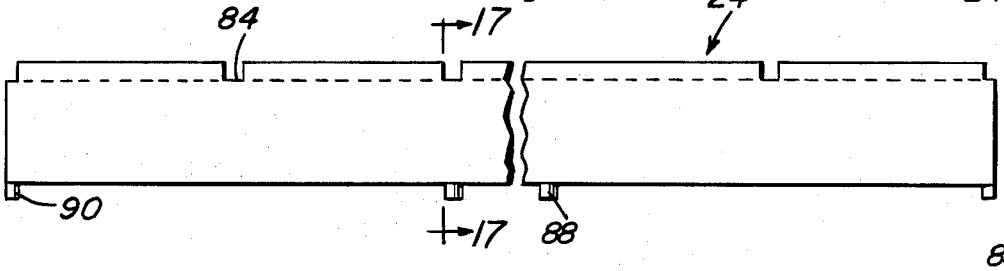
FIG. 16 is an inside plan view of the type of wall sections shown in FIGS. 14 and 15.
Figure 17:
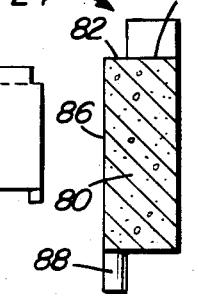
FIG. 17 is an enlarged transverse sectional view taken substantially through a plane indicated by section line 17—17 in FIG. 16.

As shown in FIGS. 14 and 15, an outside corner type of wall section 24 is provided with a beveled corner edge 92 while an inside corner wall section 24' as shown in FIG. 15 is provided with a corner beveled edge 94. Thus, corner wall sections may be assembled to form smooth, uninterrupted corners for the foundation assembly.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a building construction, a foundation assembly comprising a precast ground bearing pad having a peripheral rim portion and upstanding ribs spaced inwardly therefrom, a separate wall section, locking means securing the wall section to said peripheral rim portion, a plurality of floor surface panels locked to the wall section in spaced relation to the ground bearing pad and spacer means engageable with the upstanding ribs of the ground bearing pad for supporting and holding said floor surface panels in abutting relation to each other spaced from the ground bearing pad.

2. The combination of claim 1 including a plurality of said ground bearing pads assembled in abutting relation and a plurality of said wall sections secured by the interlocking means in overlapping relation to the ground bearing pads in abutment with each other, and means clamping the adjacent ones of the ground bearing pads to each other at abutting rim portions thereof spaced from the wall sections.

3. The combination of claim 2 including key means extending between said abutting rim portions for aligning the ground bearing pads, in planar relation to each other.

4. The combination of claim 3 wherein each of said floor surface panels includes a depending peripheral flange engageable with the wall sections and the spacer means.

5. The combination of claim 2 wherein said locking means includes a locking flange projecting from the wall sections into exterior slots formed in the rim portions of the ground bearing pads.

6. The combination of claim 5 wherein said locking means includes a locking flange projecting from the exterior face below the lower face into an exterior slot formed in the rim portions of the ground bearing pads.

7. The combination of claim 1 wherein each of said floor surface panels includes a depending peripheral flange engageable with the wall section and the spacer means.

8. In a building construction, a foundation assembly comprising a ground bearing pad having a peripheral rim portion and upstanding ribs, a wall section secured to said peripheral rim portion, a plurality of floor surface panels supported by the wall section in spaced relation to the ground bearing pad and spacer means engageable with the upstanding ribs of the ground bearing pad for holding said floor surface panels in abutting relation to each other spaced from the ground bearing pad, each of said floor surface panels includes a depending peripheral flange engageable with the wall section and the spacer means, said spacer means including a plurality of posts having opposite axial ends respectively engaged with the ribs on the ground bearing pad and abutting peripheral flanges of adjacent floor surface panels, one of the axial ends on each of said posts being slotted to receive the abutting peripheral flanges and the other of the axial ends having a projection received in recesses formed in the ribs of the ground engaging pad.

9. The combination of claim 8 wherein each of said wall sections includes a solid body of generally rectangular cross section having upper, lower, exterior and interior faces, said lower face being in bearing contact with the peripheral rim portion of the ground bearing pad, said upper face being slotted to receive the peripheral flanges of the floor surface panels and locking means projecting from the lower face into engagement with the rim portion for holding the wall section in vertical alignment with the rim portion.

10. In a building construction, a foundation assembly comprising a ground bearing pad having a peripheral rim portion and upstanding ribs, a wall section secured to said peripheral rim portion, a plurality of floor surface panels supported by the wall section in spaced relation to the ground bearing pad and spacer means engageable with the upstanding ribs of the ground bearing pad for holding said floor surface panels in abutting relation to each other spaced from the ground bearing pad, each of said floor surface panels includes a depending peripheral flange engageable with the wall section and the spacer means, each of said wall sections including a solid body of generally rectangular cross section having upper, lower, exterior and interior faces, said lower face being in bearing contact with the peripheral rim portion of the ground bearing pad, said upper face being slotted to receive the peripheral flanges of the floor surface panels and locking means projecting from the lower face into engagement with the rim portion for holding the wall section in vertical alignment with the rim portion.

11. The combination of claim 1 wherein said pad and wall section are respectively made of an integral precast body of material.

12. A prefabricated foundation assembly including a plurality of abutting pads, separate abutting wall sections assembled in peripheral relation on said pads, a plurality of abutting floor panels, and spacer means for holding the floor panels assembled and supporting the same in spaced relation on the pads, each of said pads including a planar bearing surface portion, a peripheral rim to which the floor panels are anchored and a plurality of spaced ribs projecting from the bearing surface portion in engagement with the spacer means, said spacer means including spaced posts interlocked with said ribs and the floor panels.

13. The combination of claim 12 including locking means projecting exteriorly from the wall sections for engagement with the pads to anchor the wall sections to the rims of the pads.

* * * * *